US010300628B2

(12) United States Patent
Toncelli

(10) Patent No.: US 10,300,628 B2
(45) Date of Patent: May 28, 2019

(54) TOOL AND MACHINE FOR WORKING NATURAL STONE, AGGLOMERATE OR CERAMIC MATERIAL

(71) Applicant: Dario Toncelli, Bassano del Grappa (IT)

(72) Inventor: Dario Toncelli, Bassano del Grappa (IT)

( * ) Notice: Subject to any disclaimer, the term of this patent is extended or adjusted under 35 U.S.C. 154(b) by 269 days.

(21) Appl. No.: 15/512,635

(22) PCT Filed: Sep. 22, 2015

(86) PCT No.: PCT/IB2015/057288

§ 371 (c)(1),
(2) Date: Mar. 20, 2017

(87) PCT Pub. No.: WO2016/046740

PCT Pub. Date: Mar. 31, 2016

(65) Prior Publication Data

US 2017/0291323 A1 Oct. 12, 2017

(30) Foreign Application Priority Data

Sep. 24, 2014 (IT) ..... TV2014A0140

(51) Int. Cl.
*B28D 1/08* (2006.01)
*B28D 1/00* (2006.01)

(52) U.S. Cl.
CPC ..... *B28D 1/084* (2013.01); *B28D 1/003* (2013.01); *B28D 1/082* (2013.01)

(58) Field of Classification Search
CPC ..... B28D 1/084; B28D 1/003
USPC ..... 125/21
See application file for complete search history.

(56) References Cited

U.S. PATENT DOCUMENTS 1,043,433 A * 11/1912 Jackson ..... B28D 1/082 125/21
1,778,132 A * 10/1930 Wegner ..... B24B 7/224 200/84 R
2,656,832 A 10/1953 Perrier et al.
2,795,222 A * 6/1957 Garrison ..... B23D 57/0023 125/21
3,384,417 A * 5/1968 Mylewski ..... B27B 17/02 125/21
3,545,422 A * 12/1970 McNulty ..... B28D 1/084 125/21

(Continued)

FOREIGN PATENT DOCUMENTS

EP 1740359 B1 9/2007
JP 2002210727 A 7/2002

OTHER PUBLICATIONS

PCT International Search Report and Written Opinion dated Dec. 18, 2015 for Intl. App. No. PCT/IB2015/057288, from which the instant application is based, 11 pgs.

*Primary Examiner* — George B Nguyen
(74) *Attorney, Agent, or Firm* — Fredrikson & Byron, P.A.

(57) ABSTRACT

A machine (12) for working slabs of natural stone, agglomerate or ceramic material comprises: a work bench (14) adapted to receive a slab to be machined; a machining head (16) comprising a spindle (18); and movement means (20) for moving the machining head (16) above the work bench (14). The spindle (18) comprises coupling means (40) which allow a diamond chain tool (42) to be operatively fixed.

15 Claims, 7 Drawing Sheets

(56) References Cited

U.S. PATENT DOCUMENTS 4,181,115 A * 1/1980 Weisner ..... B23D 59/001 125/21
4,321,838 A * 3/1982 Feldman ..... B27B 17/02 285/419
5,078,119 A * 1/1992 Holmes ..... B23Q 9/0014 125/13.01
5,413,158 A * 5/1995 Wirth, Jr. ..... B23D 57/0076 144/35.2
5,690,092 A * 11/1997 Ogyu ..... B28D 1/08 125/21
6,006,735 A * 12/1999 Schlough ..... B24B 9/06 125/13.01
6,178,960 B1 * 1/2001 Svensson ..... B23D 57/0015 125/21
6,186,136 B1 * 2/2001 Osborne ..... B27B 17/02 125/21
6,311,598 B1 * 11/2001 Osborne ..... B27B 17/0083 125/21
7,082,939 B2 * 8/2006 Dossena ..... B23D 61/121 125/15
2005/0229915 A1 * 10/2005 Vangundy ..... B28B 11/14 125/21
2005/0288161 A1 * 12/2005 Toncelli ..... B23C 1/002 483/31
2006/0084364 A1 * 4/2006 Toncelli ..... B28D 1/003 451/5
2006/0213340 A1 * 9/2006 Prussiani ..... B23D 45/027 83/13
2007/0215138 A1 * 9/2007 Vanderzanden ..... B23D 57/023 125/21
2008/0110311 A1 * 5/2008 Stangherlin ..... B26F 1/3813 83/177
2008/0257329 A1 * 10/2008 Brocco ..... B23D 57/0023 125/16.01
2013/0306047 A1 * 11/2013 Jonsson ..... B23D 59/008 125/21
2014/0309784 A1 * 10/2014 Toncelli ..... G05B 19/18 700/275
2015/0053196 A1 * 2/2015 Bennett ..... B23D 59/04 125/21
2015/0083103 A1 * 3/2015 Calas ..... B28D 1/003 125/14

* cited by examiner

TOOL AND MACHINE FOR WORKING NATURAL STONE, AGGLOMERATE OR CERAMIC MATERIAL

RELATED APPLICATIONS

This application is a 35 U.S.C. 371 national stage filing from International Application No. PCT/IB2015/057288, filed Sep. 22, 2015, which claims priority to Italian Application No. TV2014A000140, filed Sep. 24, 2014, the teachings of which are incorporated herein by reference.

DESCRIPTION

The present invention relates to a tool and a machine for working natural stone, agglomerate or ceramic material.

In particular, the present invention relates to a machine with four or five axes, in which a spindle, to which a tool is fitted, is moved above a working surface.

In the description below reference will be made to machines for cutting slabs, it being understood that this reference is not intended to be limiting, as will become clear below to the person skilled in the art.

Different technologies for cutting slabs are known in the present state of the art, these including for example: cutting with a diamond disk, water jet, end milling cutter, chain tool, etc. Each technology has its particular characteristics and is suitable for given type of cutting operation.

For example, for straight and very long cuts, a diamond disk is used since it allows a precise cut to be obtained, at very high feed speeds and therefore in very short periods of time.

On the other hand, should it be required to perform cuts which are smaller and/or have narrow curves it is preferable to use a water jet system.

The specific characteristics of each cutting technology will not be further described since they are known to the person skilled in the art.

As is known, there are few cases where it is possible and convenient to use a single cutting technology, as for example in the case of mutually perpendicular cuts in a chequer board arrangement.

In other cases, there may be long sections intersecting with short sections, long sections connected by curved sections, or there may be the need to form polygonal shapes. In such cases it is convenient to use alongside the diamond cutting disk a tool which is useful for cutting short or curved sections.

Moreover, there are particular combinations of cuts, for example polygonal cuts, which cannot be performed only using the diamond disk. In fact, since the cutting disk is circular and the cutting profile curved, at the point of intersection between the two intersecting sections, the cut will be incomplete so as not to damage a useful adjacent zone of the slab. Moreover, the disk may not penetrate into the slab being machined more than a certain amount, owing to the physical dimensions of the spindle to which it is fixed.

Consequently, when performing complex cuts, it is required to transfer the slab from a first machine in which a first type of cut is performed to a second machine where a second type of cut is performed. For example, the first machine may be a machine with a diamond disk, while the second machine may be provided with a water-jet cutting system.

This machining arrangement is costly since it requires the use of two machines and is subject to errors in positioning of the slab on the second machine which may result in the presence of precision defects on the finished slab.

For some years now so-called combined-cutting machines have been known in the present state of the art, these machines allowing two types of cut to be performed using a single machine, avoiding the need to transfer the slab into a second machine.

For example, machines are known where the machining head is equipped with a diamond disk and with a water-jet cutting nozzle. A machine of this type is described for example in European patent EP 1740359.

In the present description, the expression "machining head" will be used to refer to the machine part which is connected to the sleeve of the machine tool and is moved by means of the movement means of the machine and which comprises a spindle to which a tool may be coupled.

Other types of combined machines are also known, said machines combining in a single machining head a diamond disk and a diamond chain tool. In this type of machine, the diamond chain tool is extracted from the machining head so as to project by a greater amount than the cutting disk.

These machines of the prior art, although widely used and popular, are also not without drawbacks.

In fact, if on the one hand these machines allow cuts to be performed using two different technologies, on the other hand the machining heads are very complex from the technological point of view, since they must contain the components of both technologies. The machining head is therefore also difficult to maneuver inside the working space.

Moreover, since the head contains more parts compared to the heads with a single tool, it is heavier to maneuver and therefore reinforced structures suitable for supporting a greater weight are required.

The object of the present invention is therefore to solve at least partially the drawbacks of the prior art.

A first task of the present invention is to provide a machine which allows at least two types of cut to be performed, wherein the machining head is constructionally and technologically simple, while maintaining all the advantages which can be achieved with the combined machines of the known type.

Moreover, an aim is to provide a machine in which the structure required for movement of the machining head must not be reinforced.

A further task is that of providing a machine in which the machining head has small dimensions so as to ensure ample maneuvering space.

Another aim is to provide a diamond chain tool which may be used with the machines for machining slabs of stone, agglomerate or ceramic material of the known type, such as machines for milling or drilling or shaping operations.

These machines may be of the type with five axes, which have a bi-rotating head and with which it is possible to perform cuts in any direction since they have two axes of rotation, a first vertical axis and a second axis which may be horizontal or inclined in another direction with respect to the first axis; or they may be of the type with four axes, in which, in addition to translatory movements, the spindle is adapted to rotate only about a vertical axis, so that it is instead not possible to perform cuts inclined with respect to the vertical direction.

The object and the tasks are achieved with a diamond chain tool and a machine according to the attached claims.

In particular, the idea which has occurred is to provide a machine comprising a work bench adapted to receive a slab to be machined, and a machining head comprising a spindle, which via movement means may be moved above the work bench. The spindle comprises coupling means for a tool. The machine is characterized in that it comprises a diamond chain tool adapted to be coupled operatively to the spindle.

The idea which has also occurred is to provide a particular diamond chain tool comprising a fixed structure adapted to be fixed to the machining head, and a coupling cone rotatably supported inside the fixed structure and adapted to be operatively connected to the nose of a spindle. For use on machines provided with a bi-rotating head a driving pulley is arranged on one end of coupling cone. A chain support extends from the fixed structure, in a radial direction with respect to the axis of rotation of the coupling cone and is provided at its end with a driven pulley. The tool also comprises a diamond chain adapted to mesh with the driving pulley, on the driven pulley, and slide on the chain support.

For use on machines with four axes, the chain tool also comprises an angular transmission for allowing coupling to the nose of the spindle arranged vertically.

The characteristic features and advantages of a machine and a diamond chain tool according to the present invention will become clearer from the description below of possible embodiments, provided solely by way of a non-limiting explanation, with reference to the accompanying drawings, in which:

FIG. 1 shows a machine with five axes for machining slabs of natural stone, agglomerate or ceramic material according to the present invention and is denoted generally by the reference number 12.

Figure 1:
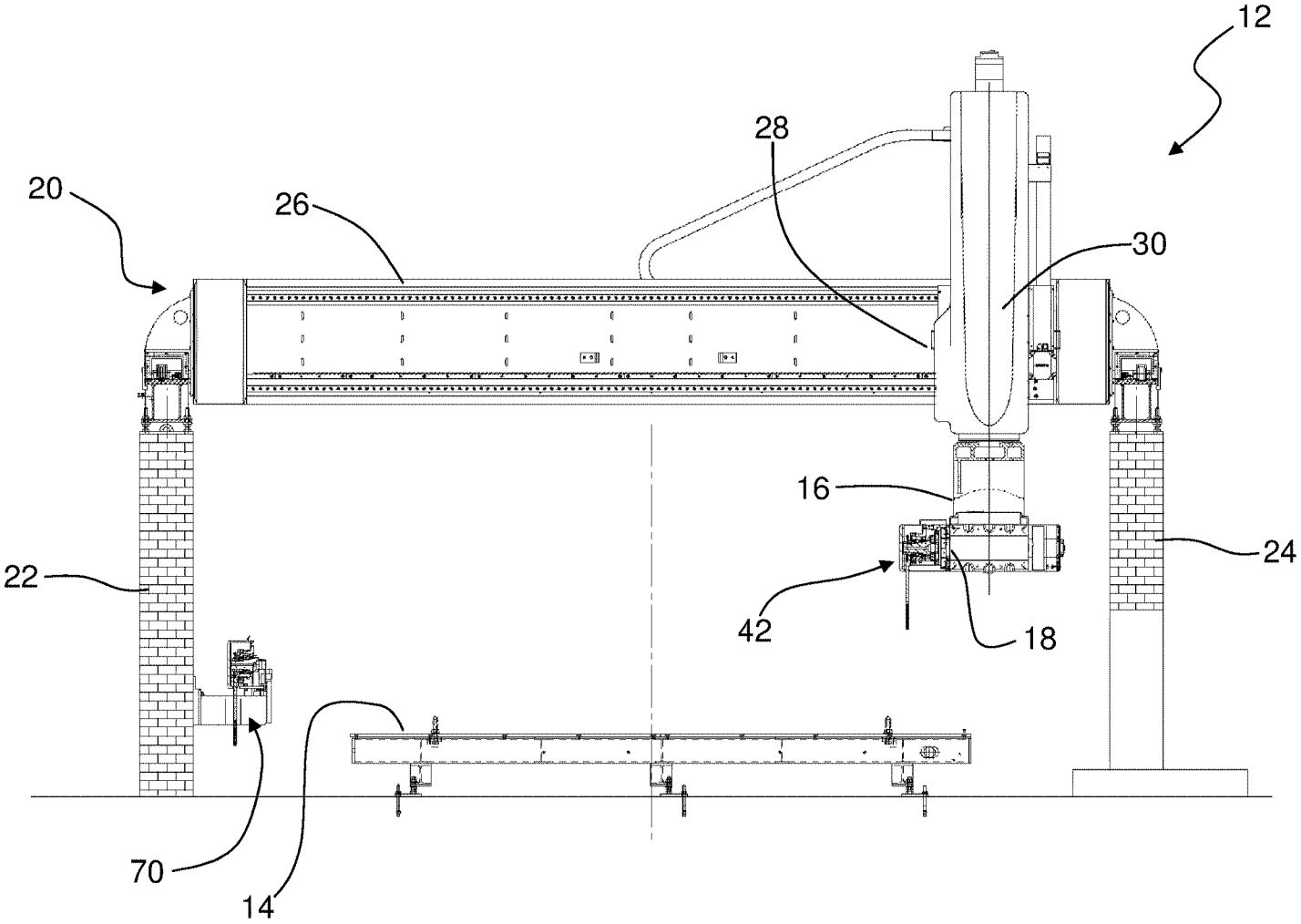
FIG. 1 shows a partially sectioned front view of a machine with five axes with a bi-rotating head to which a chain tool according to the present invention is coupled.

The machine comprises a work bench 14 which is adapted to receive a slab to be machined and may be provided with fastening means, for example of the sucker type, which are adapted to fix the slab, keeping it spaced a few centimeter s from the work bench. The work bench 14 may be of the type known per se to the person skilled in the art and will therefore not be further described. Advantageously it may be provided with a sacrificial element (not shown in the attached figures) of the type known per se, adapted to support the slab being machined and suitable for receiving incisions made by the tool used.

The machine further comprises a bi-rotating machining head 16 provided with a spindle 18 and adapted to be moved above the work bench 14 and inside a working space via the movement means 20. The spindle 18 is provided in a manner known per se with a spindle drive.

In accordance with a possible embodiment of the present invention the movement means 20 may comprise two lateral support structures 22, 24 above which a beam 26 is positioned transversely with respect thereto. The beam 26 is adapted to slide in a transverse direction above the lateral support structures 22, 24.

The means for sliding of the beam 26 above the lateral support structures 22, 24 are well-known per se to the person skilled in the art and therefore will not be further described.

A spindle carriage 28 may be arranged on the beam 26 and, via known movement means, is adapted to move along the beam 26. A spindle-holder sleeve 30 may instead slide vertically on the spindle carriage 28.

The machining head 16 is positioned at the bottom end of the spindle-holder sleeve 30.

According to the embodiment of the present invention described above, the machining head 16 may be moved in the longitudinal direction, transverse direction and away from or towards the work bench 14.

Depending on whether the machine is of the type with four or five axes, the machining head is provided with rotation means adapted to rotate the spindle 18 about a vertical axis (four axes) or also about a horizontal axis (five axes).

In particular, FIG. 1 shows a machine 12 with five axes provided with a bi-rotating machining head 16 capable of rotating the spindle 18 to which a chain tool is coupled about a vertical axis and about a horizontal axis.

Figure 2:
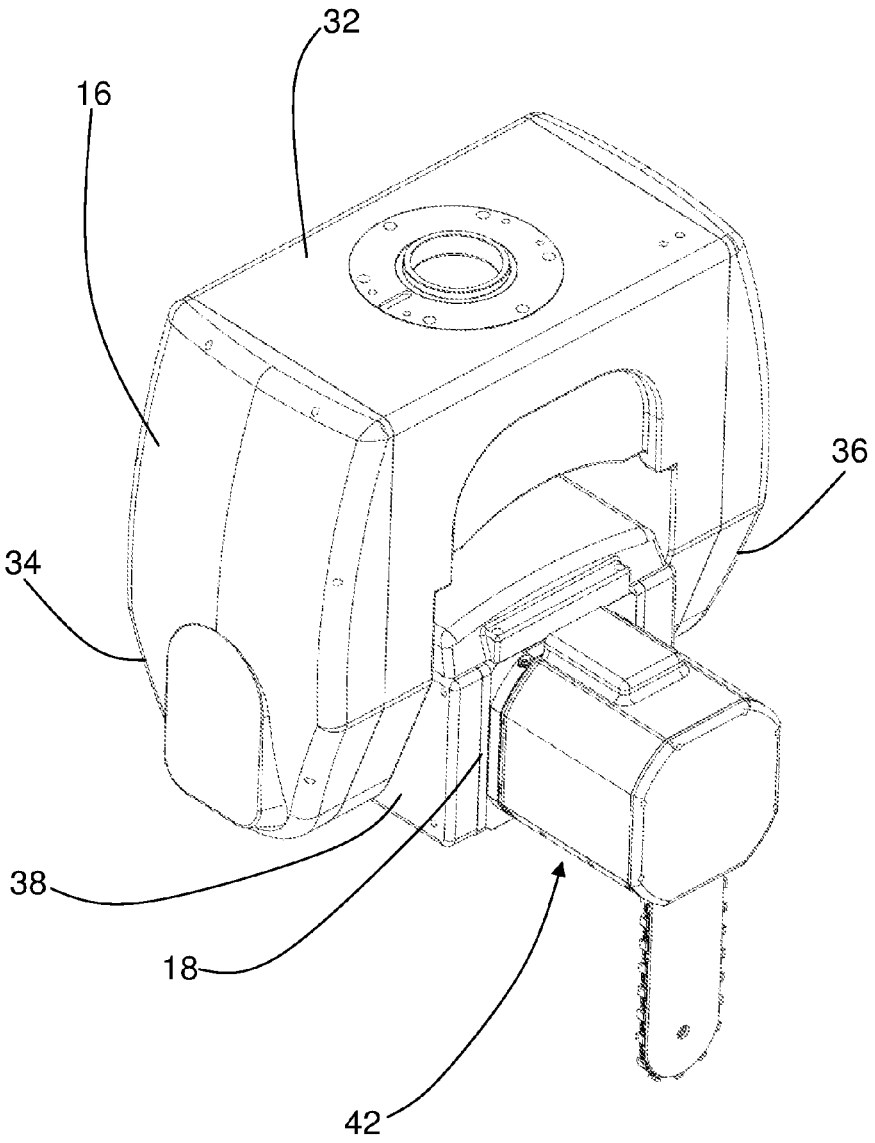
FIG. 2 shows a perspective view of a bi-rotating head of a machine with five axes with, coupled thereto, a chain tool according to the present invention.

FIG. 2 shows a view, on a larger scale, of the machining head 16 according to FIG. 1. The machining head 16 comprises a first support element 32 connected rotatably to the spindle-holder sleeve 30. The first support element may have the form of a fork with two wings 34, 36. A second support element 38 is provided rotatably between the two wings 34, 36. The second support element 38 is adapted to rotate between the two wings 34, 36 about an axis which is substantially horizontal and perpendicular to the axis of rotation of the first support element 32. The spindle 18 is provided on the second support element 38. The machining head 16 shown in FIG. 2 is commonly called a fork head.

In accordance with a possible embodiment of the present invention, the second support element 38 may be provided with a single wing. Advantageously, the second support element 38 may be arranged projecting with respect to the first support element 32.

In accordance with alternative embodiments of the present invention, the bi-rotating head may also be of a different type, for example with a second axis of rotation inclined at 45 degrees with respect to the first vertical axis of rotation.

Although these are the preferred embodiments of means for moving the machining head 16 above the work bench 14, it is possible to use in the present invention also other types of movement means, which are well-known per se and normally used by the person skilled in the art to move machining heads.

For example, the machining head may be connected to the end of a robotic arm, as may be easily imagined by the person skilled in the art.

The machine according to the present invention is characterized in that it comprises coupling means 40 which allow a first tool and a diamond chain tool 42 to be operatively fixed to the spindle 18.

Figure 3:
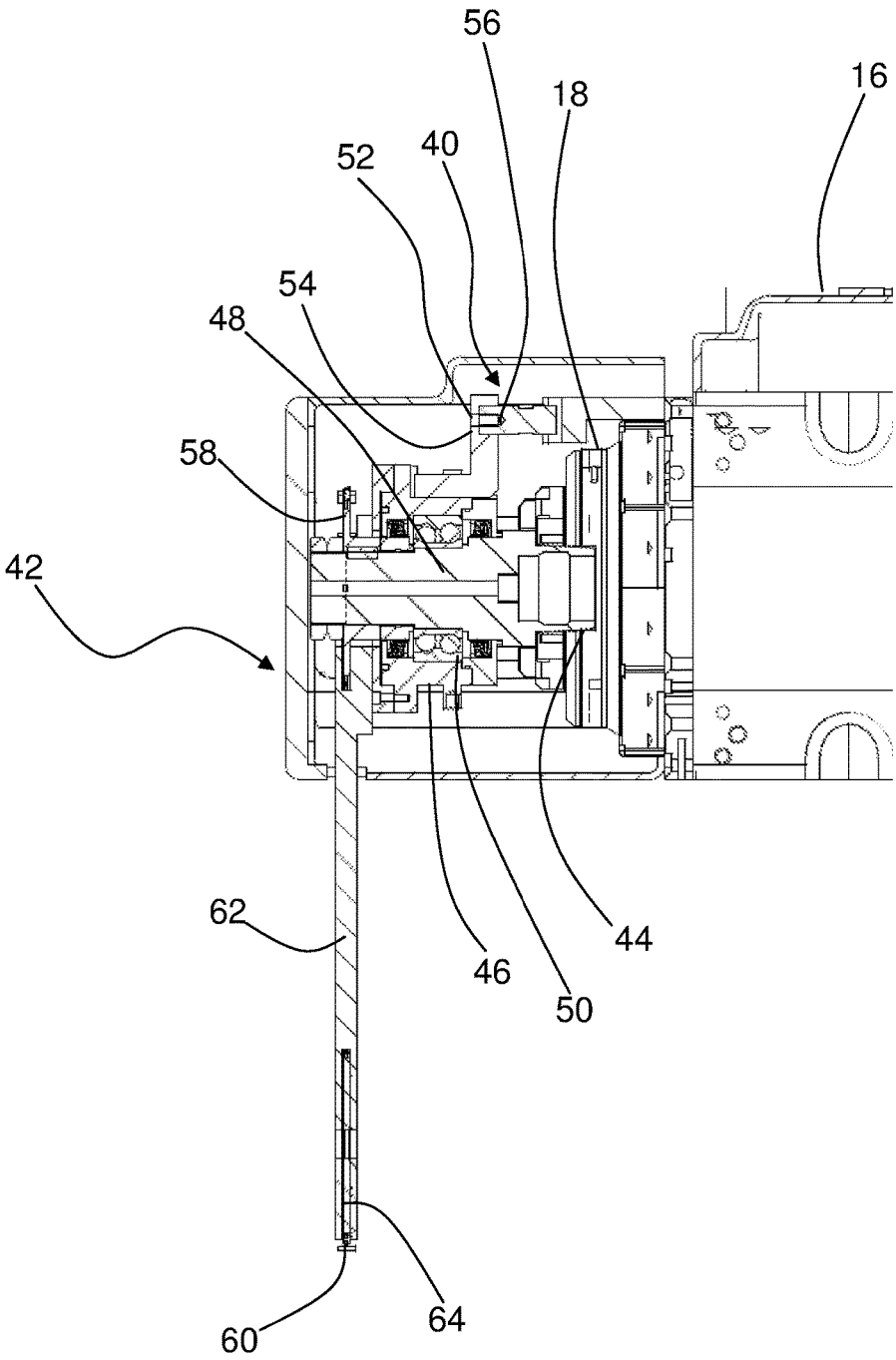
FIG. 3 shows a cross-sectional view of a chain tool coupled to a spindle of a machine with five axes according to the present invention.

FIG. 3 shows a spindle 18 of the conventional type to which a diamond chain tool 42 is connected.

The spindle 18 may be of the type known per se to the person skilled in the art, with coupling means 40 comprising a spindle nose 44 to which a tool of various types, for example a diamond disk for cutting slabs, a milling tool, a drilling tool, a shaping tool, etc., may be connected.

Figure 4:
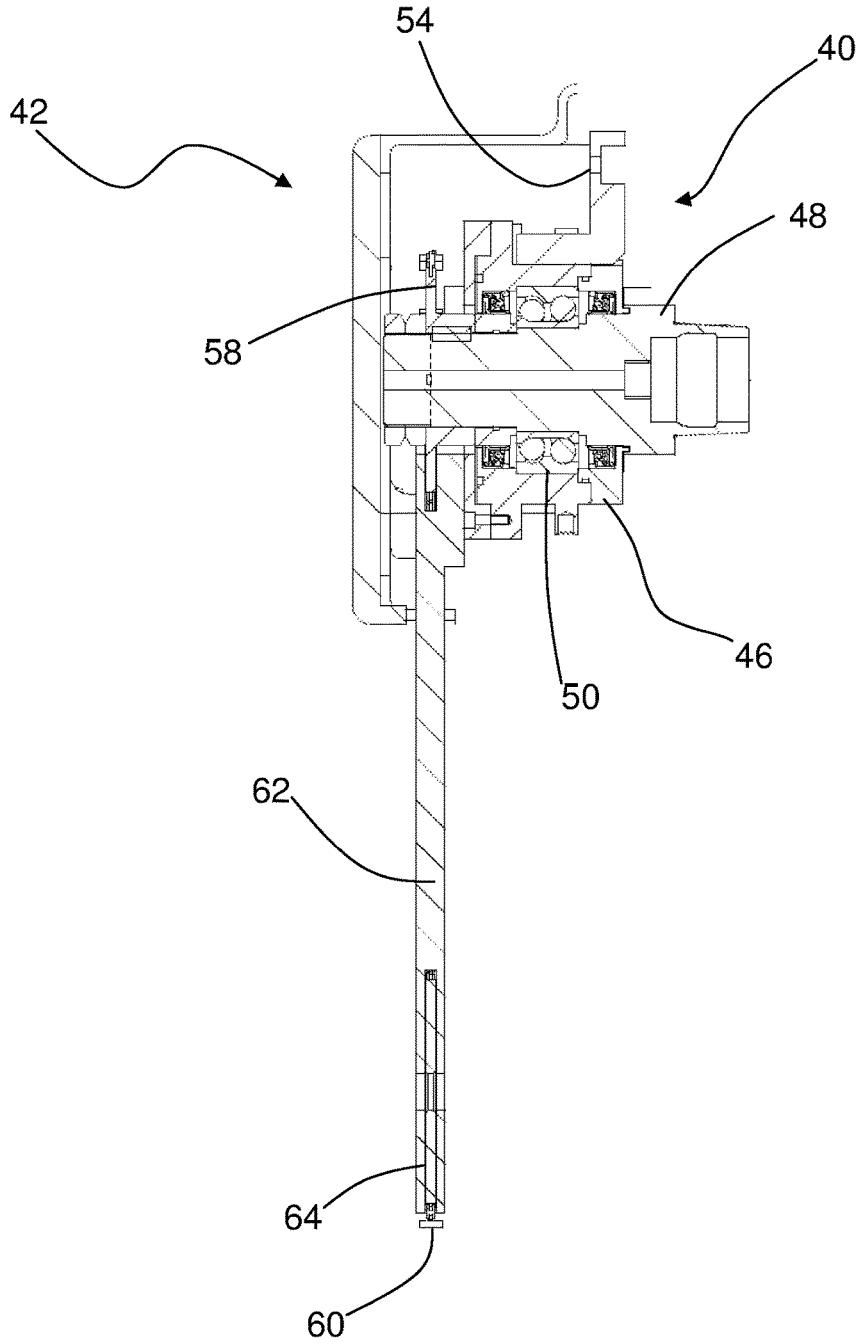
FIG. 4 shows a cross-sectional view of a chain tool for a machine with five axes according to the present invention.

The diamond chain tool 42, shown in FIG. 4, comprises a fixed structure 42 inside which a coupling cone 48, adapted to be operatively connected to the spindle nose 44, is rotatably supported.

The coupling cone 48 is supported inside the fixed structure 46, for example by means of bearings 50.

Although the diamond chain tool 42 is supported by the spindle 18 by means of the coupling cone 48, the fixed structure 46 may be locked on the external structure of the machining head 16 so that only the operating part of the tool (the diamond chain), and not the entire tool, is rotated.

Therefore, in accordance with a possible embodiment of the present invention, a pin 52 is provided, said pin being inserted inside a seat 54 of the fixed structure 46 and inside a seat 56 of the machining head 16.

Other systems for fixing the fixed structure 46 to the machining head 16 are obviously possible and may be easily imagined by the person skilled in the art.

With reference to FIG. 4, the diamond chain tool will now be described in detail.

A driving pulley 58, adapted to mesh with a diamond chain 60, is arranged at the opposite end of the coupling cone 48. The chain support 62 extends from the fixed structure 46, in the radial direction with respect to the axis of rotation of the coupling cone and in the region of the driving pulley 58. A driven pulley 64 on which the diamond chain 60 meshes is provided at the end of the chain support 62.

During operation of the tool, the diamond chain 60 meshes with the driving pulley 58 and with the driven pulley 64 and slides along the chain support 62.

As mentioned above, the fixed structure 46 does not rotate together with the coupling cone 48 since it is locked in position by the pin 52.

Owing to the bi-rotating head it is possible to perform cuts in any direction since two axes of rotation are provided, a first vertical axis and a second axis which may be horizontal or inclined in another direction with respect to the first axis.

In the case of a numerical-control machine with four axes, in which, in addition to translatory movements, the spindle is able to rotate only about a vertical axis, it is instead not possible to perform cuts inclined with respect to the vertical direction.

Figure 6:
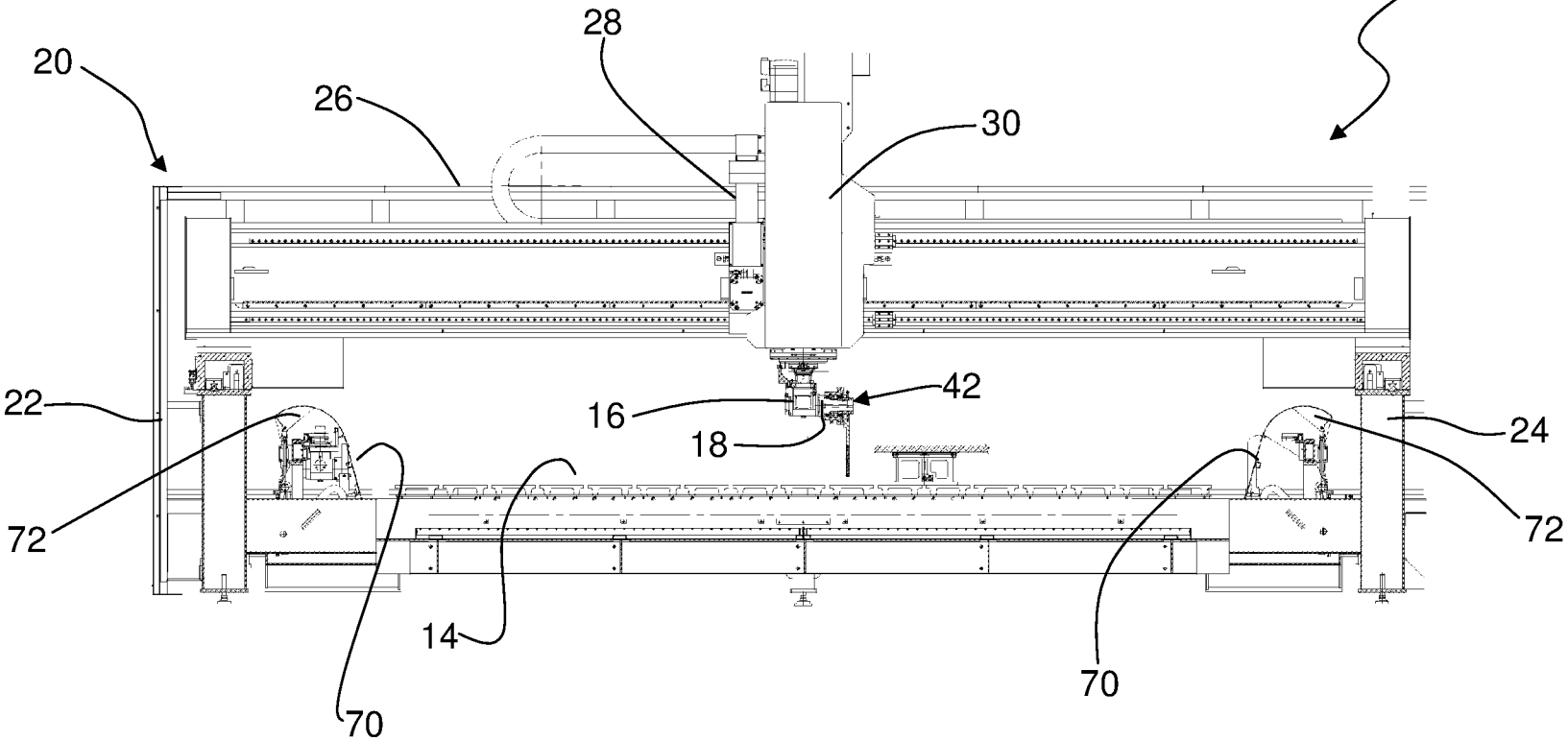
FIG. 6 shows a front view of a machine with four axes with a chain tool according to the present invention.
Figure 8:
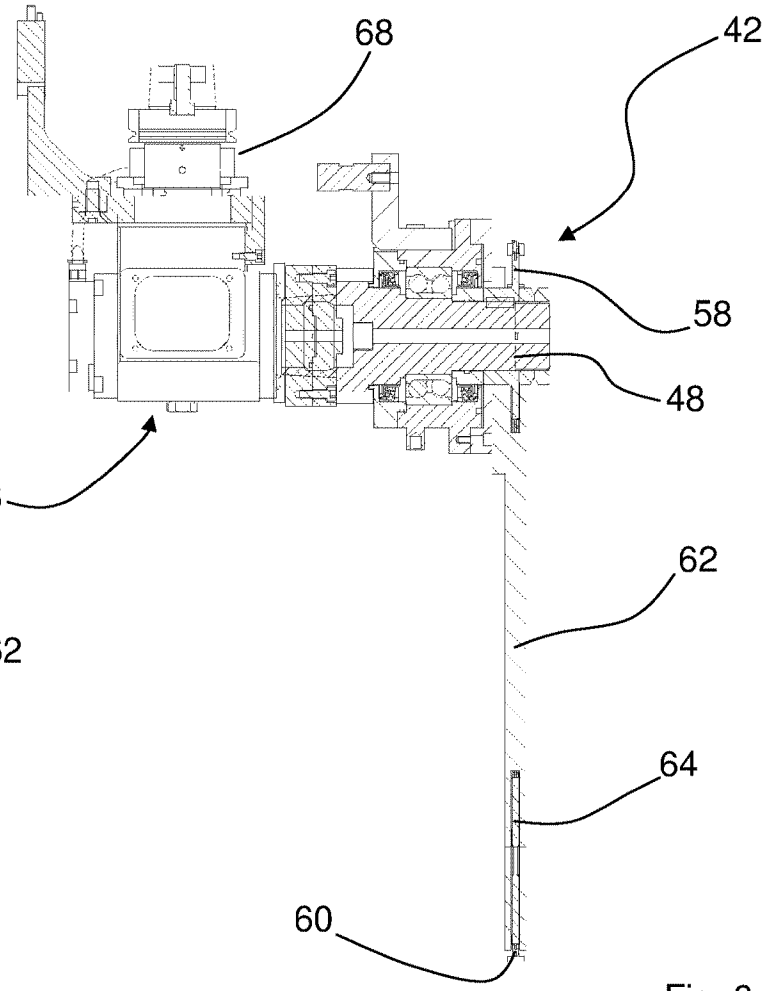
FIG. 8 shows a cross-sectional side view of the chain tool according to FIG. 7.
Figure 7:
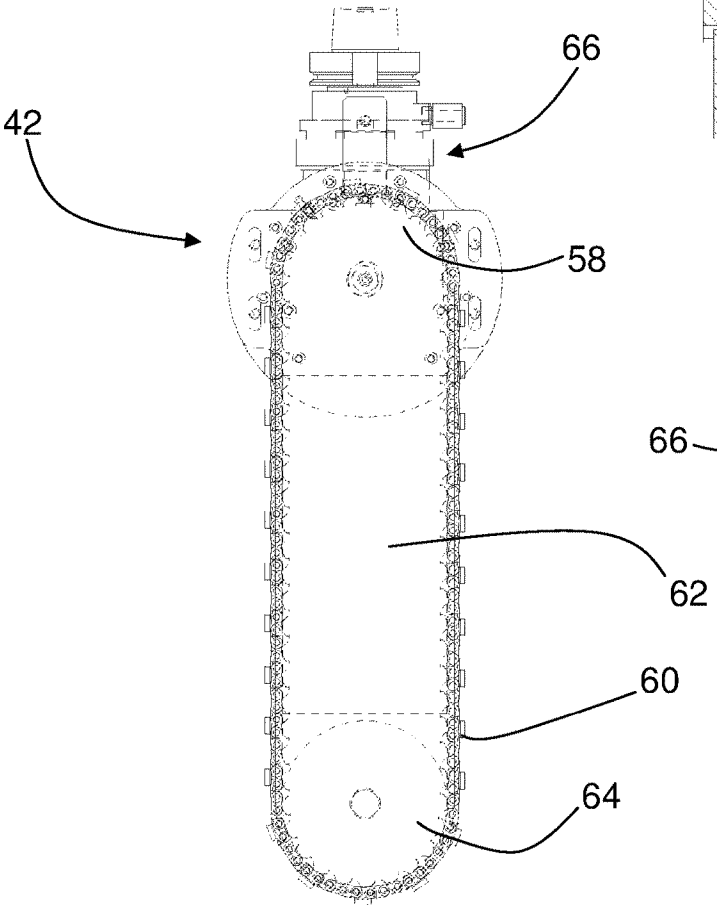
FIG. 7 shows a front view of the chain tool of the machine according to FIG. 6.

FIGS. 6 to 8 show an alternative embodiment of the present invention which has four movement axes.

As can be seen in the embodiment shown in FIG. 6 and FIG. 8, very often in this type of machine the axis of rotation of the spindle 18 has a vertical direction, i.e. perpendicular to the work bench 14. Therefore, in order to use a cutting disk tool or a diamond chain tool, it is necessary to incorporate therein an angular transmission device 66, said device being adapted to transfer the movement of a vertical-axis shaft 68 to a horizontal-axis shaft 44 to which the tool is fixed, in a manner known per se to the person skilled in the art.

The angular transmission device 66 is known per se to the person skilled in the art and therefore will not be further described.

Figure 5:
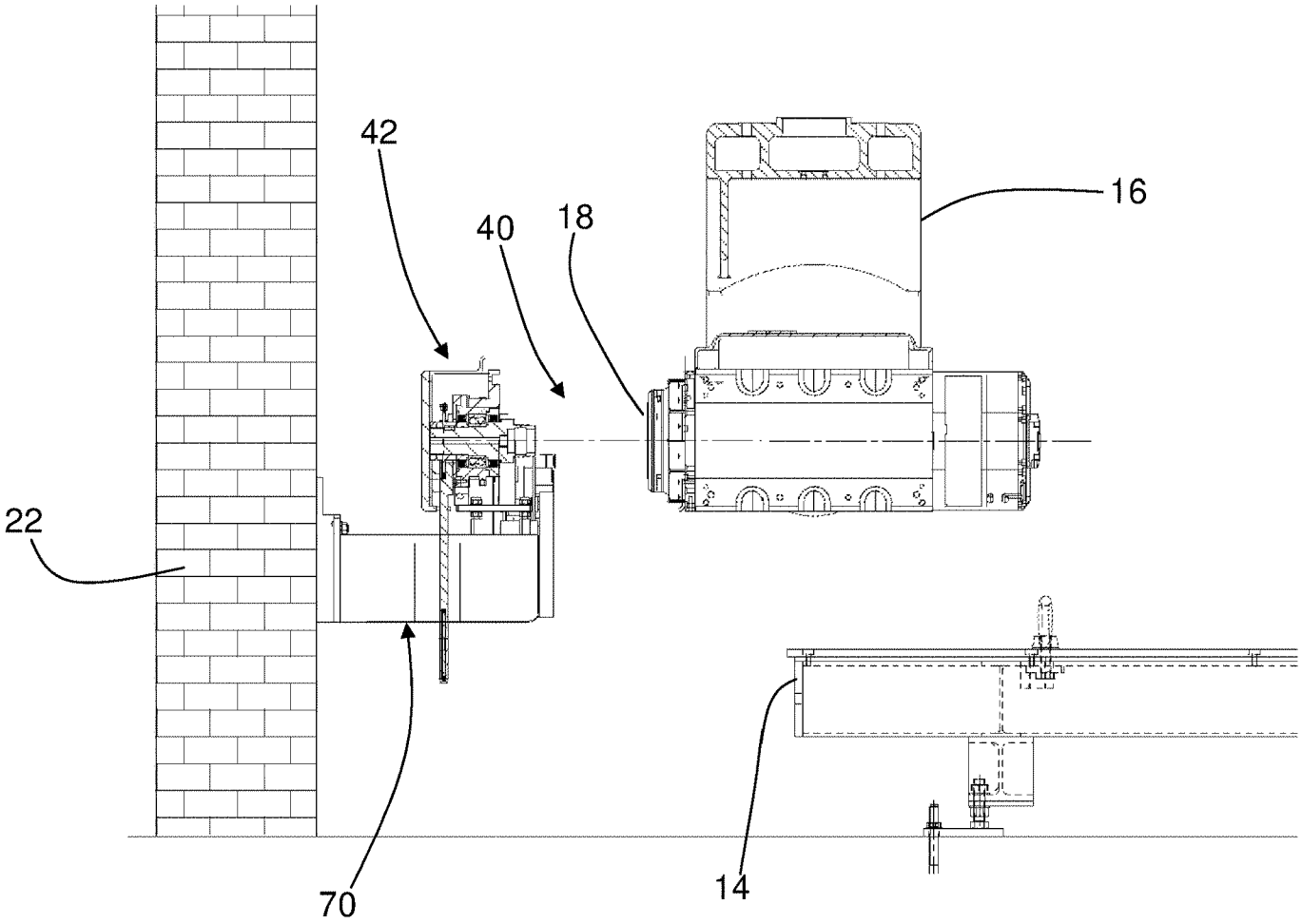
FIG. 5 shows a partial view of a machine with five axes according to the present invention in a particular operating situation.

As can be seen in FIGS. 1 and 6 and in particular in FIG. 5, the machine according to the present invention comprises at least one tool store 70.

The tool store 70 comprises at least two stations for the at least two tools which may be used with the machine according to the present invention.

As shown in the embodiment of FIG. 6, the tool store 70 may be provided with a protective cover 72 which can be manually or automatically operated.

The operating principle of the machine according to the present invention may therefore now be easily understood.

A diamond disk tool (not shown in the attached figures) may be initially operatively coupled to the spindle, which may be of the standard type, in order to carry out the type of cut which was described further above, i.e. long and straight cuts.

Once the cut with the diamond disk has been performed, the tool is replaced, with operative coupling of the diamond chain tool.

In particular, the movement means 20 bring the tool into the vicinity of the tool store 70 where the first tool is disengaged and the second tool, i.e. the diamond chain tool, is operatively connected.

In the case where there is not an automated tool change-over procedure, the operator removes the first tool and mounts the second tool, fixing the anti-rotation pin 52. Instead, in the case of an automated procedure, the operations are performed automatically using known means for operatively coupling the machining tools.

As already mentioned above, means suitable for allowing a more rapid coupling/uncoupling procedure which can be performed easily in an automatic mode may be provided as an alternative to the anti-rotation pin.

Once the diamond chain tool is operatively coupled, the final phase of the cut is performed.

The advantages which may be achieved with a machine according to the present invention are therefore evident.

With the machine according to the present invention at least two types of cut may be performed, without structural modifications to the already existing machines, with the possibility of operatively connecting a diamond chain tool.

The machining head is therefore constructionally simple and maintains in any case the advantages which can be achieved with the machines of the combined type.

The structure of the machine does not require any reinforcement and the machining head maintains practically unchanged its dimensions, while the maneuvering spaces necessary for the head remain unchanged.

The person skilled in the art, in order to satisfy specific requirements, may make modifications to the embodiments described above and/or replace the parts described with equivalent parts, without thereby departing from the scope of the accompanying claims.

In particular, the above description refers to the machining of articles in the form of a slab, but it is possible to machine also articles which have a different initial form such as that of a block.

It is also possible to envisage an embodiment in which the diamond chain tool is operatively coupled without removing beforehand the first tool. For example an embodiment is possible where the tool with cutting disk is adapted to be operatively coupled together with a diamond chain tool.

The invention claimed is:

1. A diamond chain tool comprising:

a fixed structure and a coupling cone rotatably supported inside the fixed structure, said cone adapted to be operatively connected to a nose of a spindle;

means for engagement with a machining head of a machine tool adapted to prevent rotation of the fixed structure with respect to the machining head; and a driving pulley being arranged on one end of the coupling cone, a chain support extending from said fixed structure in a radial direction relative to the axis of rotation of the coupling cone and being provided at one end with a driven pulley;

wherein the tool further comprises a diamond chain in meshing engagement with the driving pulley and with the driven pulley.

2. The diamond chain tool according to claim 1, characterized in that said engagement means comprise a first seat on a surface of the machining head and which in operating conditions is close to the fixed structure, and wherein a second seat on the fixed structure in the operating conditions is adapted to be aligned with the first seat for insertion of an anti-rotation pin.

3. The diamond chain tool according to claim 1, characterized in that the coupling cone is supported inside the fixed structure by means of bearings.

4. The diamond chain tool according to claim 1, further comprising an angular transmission device for allowing coupling to a machine with four axes.

5. A machine for working slabs of natural stone, agglomerate or ceramic material, comprising:

a work bench adapted to receive a slab to be machined;

a machining head comprising a tool-holder spindle, said spindle comprising coupling means for a machining tool; and movement means for moving the machining head above the work bench;

wherein said machine comprises a diamond chain tool adapted to be coupled operatively to said spindle by means of said coupling means.

6. The machine according to claim 5, wherein the diamond chain tool comprises: a fixed structure and a coupling cone rotatably supported inside the fixed structure, said cone adapted to be operatively connected to a nose of a spindle; means for engagement with the machining head of the machine adapted to prevent rotation of the fixed structure with respect to the machining head; and a driving pulley being arranged on one end of the coupling cone, a chain support extending from said fixed structure in a radial direction relative to the axis of rotation of the coupling cone and being provided at one end with a driven pulley; wherein the tool further comprises a diamond chain in messing engagement with the driving pulley and the driven pulley.

7. The machine according to claim 5, characterized in that the movement means comprise two lateral support structures, above which a beam is positioned transversely thereto, the beam being adapted to slide in a transverse direction above the lateral support structures; and further comprising a spindle carriage suitable for moving along the beam and being arranged on said beam, wherein a spindle-holder sleeve adapted to slide vertically is arranged on the spindle carriage, the machining head being positioned on a lower end of the spindle-holder sleeve.

8. The machine according to claim 5, characterized in that the movement means comprise a robotic arm.

9. The machine according to claim 5, wherein the machine has five movement axes.

10. The machine according to claim 9, characterized in that the machining head is a bi-rotating head.

11. The machine according to claim 10, characterized in that the machining head comprises a first support element rotatably connected to the spindle-holder sleeve, said first support element shaped in a form of a fork with two wings ,a second support element being arranged rotatably between the two wings, said second support element being adapted to rotate about a substantially horizontal axis perpendicular to an axis of rotation of the first support element, the spindle being arranged on the second support element.

12. The machine according to claim 10, further comprising a first vertical axis of rotation and a second axis of rotation inclined at about 45° with respect to the first vertical axis.

13. The machine according to claim 5, wherein the machine has four axes of movement for the spindle.

14. The machine according to claim 5, further comprising a tool store inside a space within which the machining head is movable.

15. The machine according to claim 5, further comprising at least one other tool belonging to the following group: a diamond cutting disk, a milling tool, a drilling tool, and a shaping tool.

* * * * *